United States Patent [19]

Anderson et al.

[11] Patent Number: 4,746,035

[45] Date of Patent: May 24, 1988

[54] LIQUID DISPENSER HAVING A TAMPERPROOF OVERCAP

[75] Inventors: Walter F. Anderson, West Covina; Richard P. Grogan, Downey, both of Calif.

[73] Assignee: Calmar, Inc., Watchung, N.J.

[21] Appl. No.: 938,841

[22] Filed: Dec. 8, 1986

[51] Int. Cl.[4] ..... B67D 5/32; B65D 41/32

[52] U.S. Cl. ..... 222/153; 222/182; 215/252; 215/253

[58] Field of Search ..... 215/252, 253; 222/153, 222/182, 541

[56] References Cited

U.S. PATENT DOCUMENTS 3,037,672 6/1962 Gach .
3,170,603 2/1965 Kitterman .
3,463,341 8/1969 Fields ..... 215/252
3,474,930 10/1969 Lerner .
3,504,818 4/1970 Crisci et al. .
3,874,540 4/1975 Hidding .
3,955,716 5/1976 Goncalves .
4,371,097 2/1983 O'Neill .

*Primary Examiner*—Joseph J. Rolla
*Assistant Examiner*—Lisa C. Waag
*Attorney, Agent, or Firm*—Watson, Cole, Grindle & Watson

[57] ABSTRACT

A liquid dispenser has a closure cap for mounting the dispenser on a liquid container, and a non-removable tamperproof overcap secured to the closure cap. The overcap has a line of weakening to facilitate overcap separation to gain access to the dispenser actuator. And, the closure cap has a tamperproof ring.

5 Claims, 2 Drawing Sheets

FIG. 1
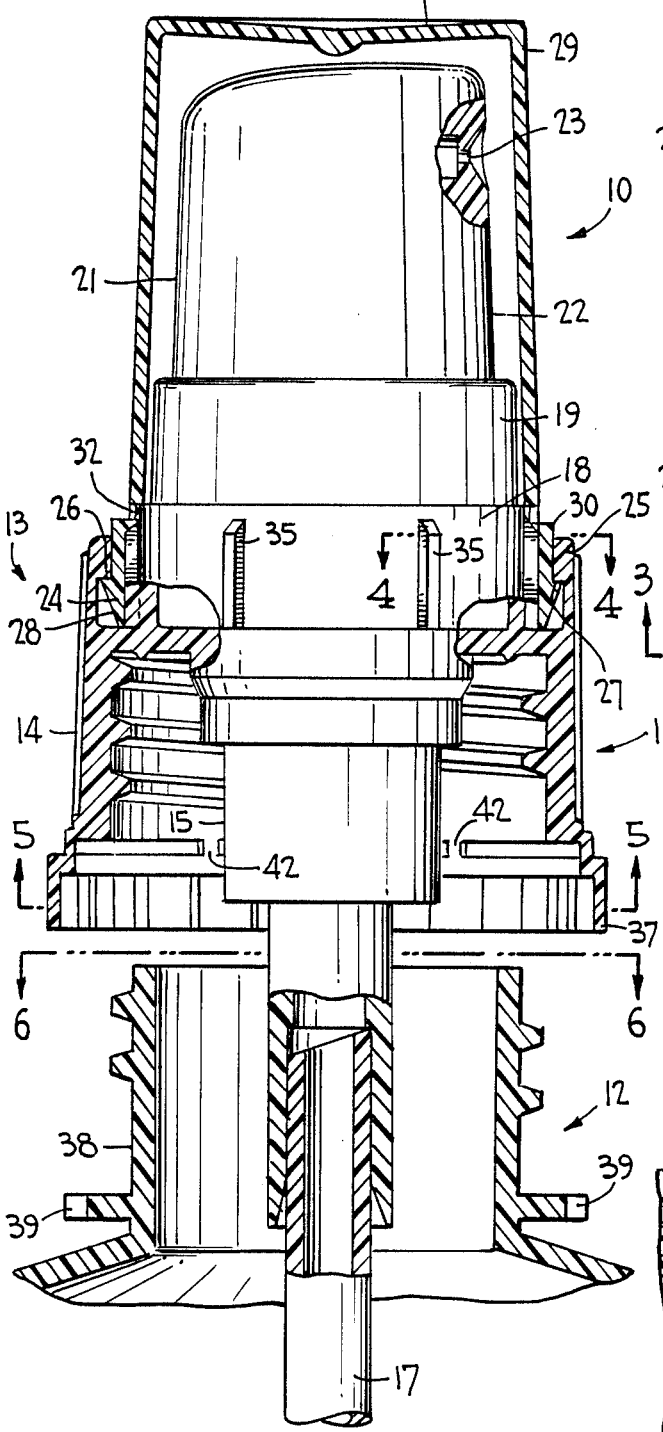
FIG. 2
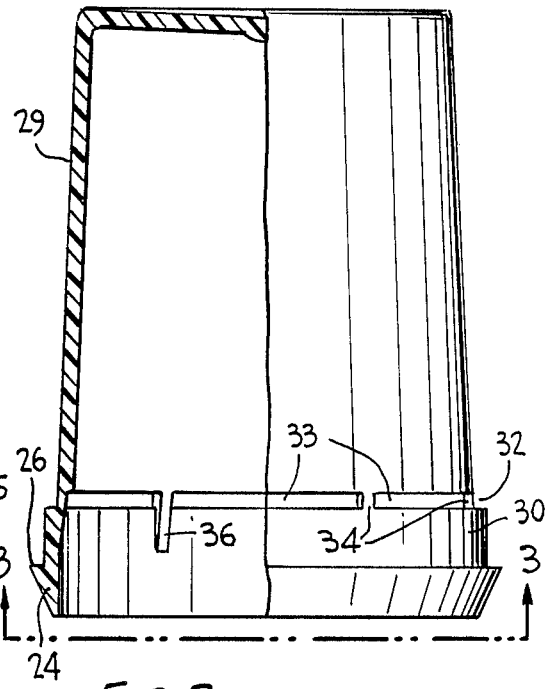
FIG. 3
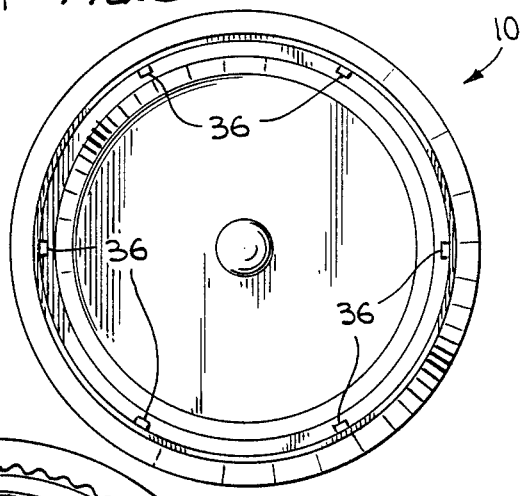
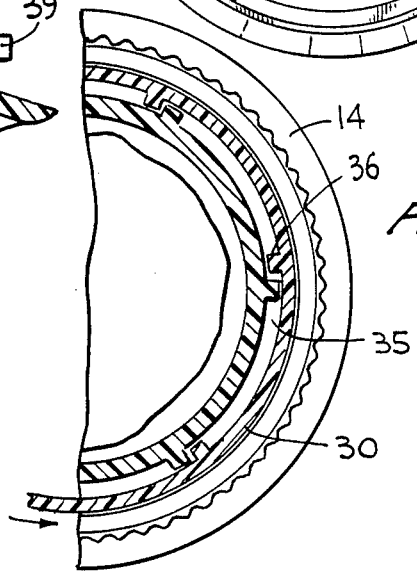
FIG. 4

LIQUID DISPENSER HAVING A TAMPERPROOF OVERCAP

BACKGROUND OF THE INVENTION

This invention relates generally to a manually operated liquid dispenser having a tamperproof protective overcap covering the dispensing actuator. And, the dispenser is mounted on a liquid container by a closure cap having a tamperproof ring.

Manually actuated dispensers, of both the pump and aerosol varieties, are frequently provided with a protective overcap for shielding the dispensing actuator against inadvertent actuation during shipping and storage. The overcap is generally pressed fitted or snap fitted in place necessitated overcap removal prior to the dispensing operation. The overcap may be discarded after removal or replaced on the dispenser.

Protective overcaps for especially aerosol dispensers have been made tamperproof by the provision of a non-removable overcap having a fracture line permitting cap seaparation in response to an external force exerted against an upper portion of the overcap. And, the overcap is structured for replacement after cap separation which also required special construction of the container itself on which the overcap is mounted.

Also, tamperproof bottle closures are known as having a tamperproof ring connected by frangible ties and locked to the container such that the cap may be removed only upon rupturing the connecting ties thereby indicating a possible tampering with the bottle contents.

SUMMARY OF THE INVENTION

It is an object of the present invention to provide a manually operated liquid dispenser having a protective overcap covering the dispenser actuator, the overcap being non-removably retained on a closure cap of the dispenser employed for mounting the dispenser on a liquid container, the overcap having a line of weakening to permit overcap separation to gain access to the actuator. The separated overcap is oversized relative to the dispenser such that the overcap cannot be replaced, thereby providing a visual indication of any tampering. And, a tamperproof ring may be provided for locking the closure cap on the container to indicate possible tampering with the container contents by a ring that is broken away from the closure cap upon cap turning.

More specifically, circumferentially spaced apart stops are provided between the overcap and the closure cap permitting limited turning movement of the overcap prior to separation. And, cooperating flanges acting between the overcap and closure cap retain the overcap in place by snap-fitting engagement.

Other objects, advantages and novel features of the invention will become more apparent from the following detailed description of the invention when taken in conjunction with the accompanying drawings.

BRIEF DESCRIPTION OF THE DRAWINGS

FIG. 1 is a side elevational view, partly in section, of a dispenser mounted overcap according to the invention, and of the neck portion of a liquid container on which the dispenser is mounted;

FIG. 2 is a side elevational view, partly in section, of the dispenser overcap of FIG. 1;

FIG. 3 is a bottom plan view of the overcap taken substantially along the line 3—3 of FIG. 2;

FIG. 4 is a cross-sectional view taken substantially along the line 4—4 of FIG. 1;

DETAILED DESCRIPTION OF THE INVENTION

Figure 5:
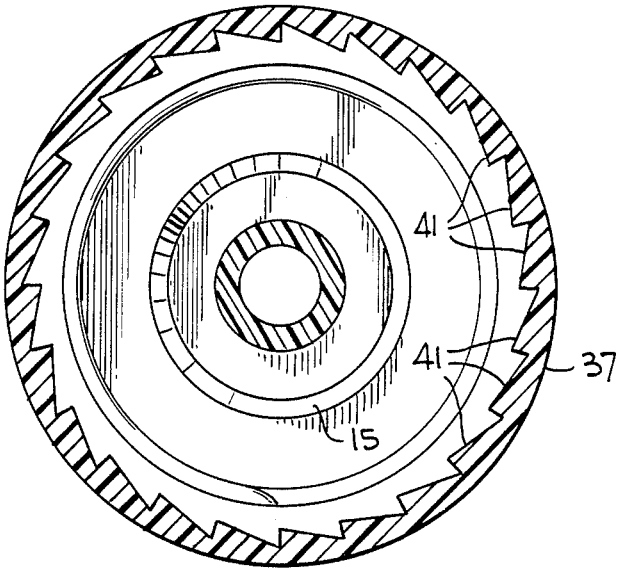
FIG. 5 is a cross-sectional view taken substantially along the line 5—5 of FIG. 1.

Turning now to the drawings wherein like reference characters refer to like and corresponding parts throughout the several views, FIG. 1 shows a protective overcap 10 according to the invention secured to a liquid dispensing pump 11 adapted to be mounted on a container 12 of liquid to be dispensed. The dispensing pump is similar to that disclosed in U.S. Pat. No. 4,371,097, commonly owned herewith, although other dispensing pumps may be equipped with the present protective overcap without departing from the invention. The dispenser includes a pump body 13 having an internally threaded closure cap 14 supporting a pump cylinder 15 having a depending inlet conduit 16. A dip tube 17 is pressure fitted within the inlet conduit and extends below the level of liquid within container 12 as in any conventional manner.

The pump body further includes an upstanding annular wall having a lower portion 18 of larger external diameter than an upper portion 19 thereof. A pump plunger (not shown) is mounted for reciprocation within the pump cylinder, and a plunger head 21 engages the plunger for manual reciprocation thereof in the normal manner by external mannual pressure applied to the upper end of the head. Skirt 22 of the plunger head slides along the inner surface of annular wall 18,19 and has a discharge opening 23 through which liquid product is dispensed during pumping, as in the manner known in this art and shown in the aforementioned patent.

Overcap 10 is generally of inverted cup-shaped configuration overlying the plunger head normally to protect the same from inadvertent actuation or from damage incident to rough treatment during shipping, handling and storage. As usual, the overcap renders the reciprocable portion of the pump inaccessible for actuation without first removing the overcap. However, the overcap is retained on the closure cap against removal by the provision of a radially outwardly extending flange 24 interengaging a radially inwardly extending flange 25 on the closure cap. The flanges present confronting stop shoulders 26, 27 which interengage as flange 24 is snap-fitted into the fully mounted position of the overcap shown in FIG. 1. Flange 24 has a downwardly converging conical outer surface 28 to facilitate the snap-fit of the overcap in place.

Annular wall 29 of the overcap, at its lower end, engages annular wall portion 18 of the dispenser body, although the remaining upper portion of wall 29 and its end wall 31 are spaced from annular wall portion 19 of the pump body and from plunger head 21.

The tamperproof overcap of the invention is provided with a line 32 of weakening, or fracture line, defined by discontinuous slits 33 and circumferentially spaced frangible connecting ties 34. Line 32 lies substantially at the junction between annular wall portions 18 and 19, as shown in FIG. 1, and defines a tamperproof ring 30 which remains on the closure cap after overcap separation. Thus, upon application of an external force applied to the upper portion of the overcap as by manually grasping the same and turning the overcap in either direction, or by pushing against overcap wall 29, the upper portion is separated from its lower portion along line 32 as the frangible ties are broken, thereby leaving ring 30 attached to the closure cap. As an alternative to slits 33 and ties 34, line 32 may be defined by an annular V-groove providing a thin wall portion capable of being fractured upon application of the external force, without departing from the invention.

Upon overcap separation as afore-described, a visible indication of any tampering is given such that the absence of such indication assures the purchaser that the contents are intact and unadulterated. And, the separated portion of the overcap cannot be replaced over the dispensed body since the overcap is oversized relative to wall portion 19 of the dispenser body, and to plunger head 21, and cannot therefore engage the dispenser for replacement. Thus, any attempt to replace the separated overcap on the dispenser body will give further evidence of tampering since the replaced overcap cannot be properly seated in place.

Provision is also made for partial turning of the overcap in either direction before effecting separation. Thus, a plurality of circumferentially spaced, longitudinally extending stop ribs 35 are provided on the outer surface of wall portion 18, and a corresponding number of circumferentially spaced, longitudinally extending stop ribs 36 are provided on the inner surface of ring 30 of the overcap. In the illustration given, six of such ribs 35 and 36 are provided thereby requiring overcap rotation through at least 60° before effecting separation by turning. Of course, fewer or more than the number of ribs shown may be provided, so long as cooperating stops are provided between the overcap and closure cap to arrest turning to effect separation. Such cooperating stops are provided to simplify the assembly of the overcap on the closure cap, and to avoid loosening of the closure cap from the container during overcap separation.

Figure 6:
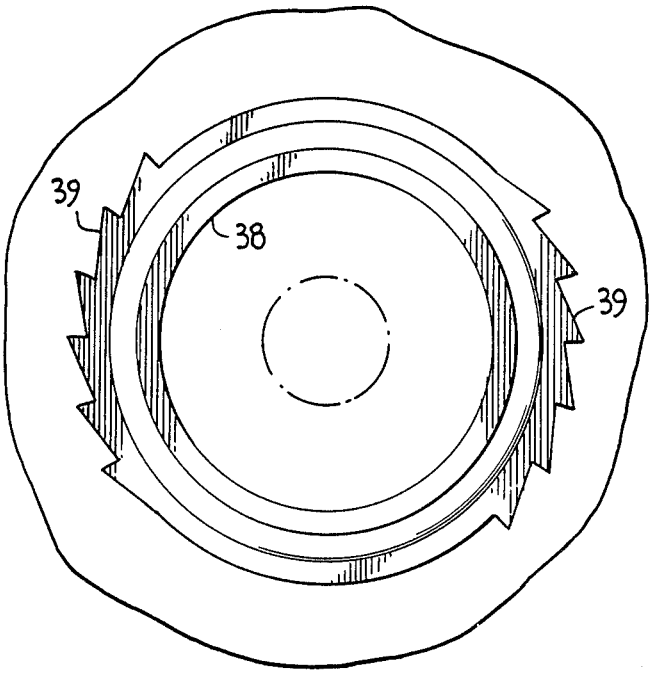
FIG. 6 is a top plan view of the bottle neck taken substantially along the line 6—6 of FIG. 1.

The closure cap may likewise be rendered tamperproof to indicate possible tampering with the container by means of a telltale ring 37 which breaks away from the closure cap upon turning the cap in the direction of opening. Neck 38 of the container is externally threaded as shown in FIG. 1, and has a plurality of triangularly shaped ratchet teeth 39, shown more clearly in FIG. 6, located beneath the external threads and extending radially outwardly from the neck. Ring 37 has a plurality of triangularly shaped internal pawls 41, shown in FIG. 5, for engaging one or more ratchet teeth 39 when the closure cap is threaded down over the container neck. As in the known manner, ring 37 is sufficiently flexible to permit pawls 41 to slide over the ratchet teeth in the process of tightening the closure cap in place. And, interengagement between pawls 41 and ratchet teeth 39 prevent turning of the closure cap in a loosening direction. Ring 37 is connected to the lower end of the closure cap by a plurality of circumferentially spaced, longitudinally extending frangible ties 42 which will sever upon the application of a sufficient turning force in a loosening direction against the locking force acting between teeth 39 and pawls 41. The separated ring 37 therefore provides a telltale indication of tampering.

Obviously, many modifications and variations of the present invention are made possible in the light of the above teachings. It is therefore to be understood that within the scope of the appended claims the invention may be practiced otherwise than as specifically described.

What is claimed is:

1. A liquid dispenser comprising, a dispenser body, a closure cap for mounting said body on a container of liquid to be dispensed, said body including a manual actuator having a discharge opening for dispensing liquid, and a protective overcap of inverted cup-shaped configuration overlying said actuator, interengaging means on said overcap and said closure cap for nonremovably retaining said overcap on said closure cap, circumferentially spaced apart, cooperating stop means on said overcap and said closure cap permitting limited turning movement of said overcap about the central axis of said body, said overcap having a side wall containing a line of weakening located outwardly of said interengaging means to facilitate separation of said overcap along said line upon application of an external force for permitting access to said actuator.

2. The dispenser according to claim 1, wherein said overcap line of weakening defines a tamperproof ring portion, said remaining portion of said overcap being spaced from said dispenser body and said actuator to avoid any interengagement therewith after overcap separation.

3. The dispenser according to claim 1, wherein said container has an externally threaded neck portion, said closure cap having internal threads in threaded engagement with said neck portion, at least one locking tooth on said container, a tamperproof ring having a plurality of triangularly shaped internal pawls, a plurality of circumferentially spaced, longitudinally extending frangible ties interconnecting said ring with said closure cap, one of said pawls engaging said tooth for locking said closure cap in said threaded engagement with said neck portion.

4. The dispenser according to claim 1, wherein the stop means comprise a plurality of longitudinally extending external ribs on said dispenser body and a plurality of longitudinally extending internal ribs on said overcap.

5. A liquid dispenser comprising, a dispenser body, a closure cap for mounting said body on a container of liquid to be dispensed, said body including a manual actuator having a discharge opening for dispensing liquid, and a protective overcap of inverted cup-shaped configuration overlying said actuator, interengaging means on said overcap and said closure cap for nonremovably retaining said overcap on said closure cap, said interengaging means comprising confronting flanges on said overcap and said closure cap defining interengaging stop shoulders, said flange on said overcap having an inwardly converging conical end facilitating a snap-fitting engagement with said closure cap flange, said overcap having a side wall containing a line of weakening located outwardly of said interengaging means to facilitate separation of said overcap along said line upon application of an external force for permitting access to said actuator, said overcap flange being retained on said closure cap upon the separation of said overcap along said line.

* * * * *